US006053548A

United States Patent [19]

Bowles, Jr.

[11] Patent Number: 6,053,548

[45] Date of Patent: Apr. 25, 2000

[54] MANUALLY-OPERABLE COMBINATION SHOVEL AND PLOW FOR SNOW AND OTHER MATERIAL

[76] Inventor: Louis G. Bowles, Jr., 1602 Wendover Dr., High Point, N.C. 27262

[21] Appl. No.: 09/261,284

[22] Filed: Mar. 2, 1999

[51] Int. Cl.[7] ..... E01H 5/02

[52] U.S. Cl. ..... 294/54.5; 294/53.5; 294/58; 37/284; 37/285

[58] Field of Search ..... 294/51, 53.5, 54.5, 294/57, 58; 37/265, 284, 285; 172/372

[56] References Cited

U.S. PATENT DOCUMENTS

| | | | |
|---|---|---|---|
| 2,513,230 | 6/1950 | Bourne et al. | 37/284 |
| 2,772,490 | 12/1956 | Hnastchenko | 37/284 |
| 2,896,993 | 7/1959 | Pollock | 294/54.5 |
| 2,919,153 | 12/1959 | Benton | 294/54.5 |
| 2,967,363 | 1/1961 | Meier | 294/53.5 |
| 3,583,747 | 6/1971 | Lambert | 294/53.5 |
| 4,245,411 | 1/1981 | McMath . | |
| 4,264,095 | 4/1981 | Lemasters . | |
| 4,597,204 | 7/1986 | Heiden | 294/54.5 |
| 4,910,893 | 3/1990 | Asay . | |
| 5,431,468 | 7/1995 | Rosenshine | 294/54.5 |

*Primary Examiner*—Dean J. Kramer
*Attorney, Agent, or Firm*—Adams Law Firm, P.A.

[57] ABSTRACT

A manually-operable shovel for efficiently moving material, including a shovel blade, a shovel handle, a joint for attaching the shovel blade to the shovel handle, and an articulation device cooperating with the joint for permitting the operator to position the blade to a predetermined fixed angle in relation to the direction of blade movement for moving the material in a predetermined desired relation to the direction of blade movement. The articulation device is moveable between an unlocked position wherein the angle of the blade in relation to the direction of blade movement is variable and a locked position wherein the angle of the blade is locked into a fixed angle in relation to the direction of blade movement. The articulation device automatically assumes the locked position during a forward, material engaging movement of the shovel and automatically assumes the unlocked position during a rearward material disengaging, movement of the shovel.

10 Claims, 8 Drawing Sheets

MANUALLY-OPERABLE COMBINATION SHOVEL AND PLOW FOR SNOW AND OTHER MATERIAL

TECHNICAL FIELD AND BACKGROUND OF THE INVENTION

This invention relates to a shovel particularly adapted for being manually used to shovel snow and other material, for example, mud, leaves, other yard debris and sawdust. The term "shovel" as used herein refers interchangeably to an implement which can be used to shovel, i.e., lift and displace, or to plow, i e., push and displace, the materials.

Manually shoveling snow and other heavy material is physically demanding. Users generally alternate between a true "shoveling" motion where a quantity of the material is displaced from a surface onto the blade, the blade is lifted and the materials thrown off of the blade, and a "plowing" motion, where the shovel is pushed along the ground, pushing the material in advance of the blade. In this motion, many times the weight that can be lifted is pushed aside. This plowing motion is therefore potentially more efficient, since more material can be moved, without the need of lifting both the shovel and the material off of the ground. This can be much less demanding on the shoulders, back and arms. However, a conventional shovel handle does not provide sufficient stability to easily and efficiently guide the shovel, particularly when the blade is pushing a large quantity of material.

Moreover, the fixed position of the blade with reference to the handle does not permit the user to shovel straight along, for example, a walk or driveway, while diverting the material off to the side in a plowing motion. The invention disclosed and claimed in this application presents a solution to these and other problems.

SUMMARY OF THE INVENTION

Therefore, it is an object of the invention to provide a manually-operable shovel which is simple to use and maintain.

It is another object of the invention to provide a manually-operable shovel which can be used interchangeably with a shoveling and plowing motion.

It is another object of the invention to provide a manually-operable shovel having a blade which can be articulated with reference to the direction of movement of the shovel to divert material to the side.

It is another object of the invention to provide a manually-operable shovel which is less labor-intensive.

It is another object of the invention to provide a manually-operable shovel which is less likely to cause over-exertion of the user.

These and other objects of the present invention are achieved in the preferred embodiments disclosed below by providing a manually-operable shovel for efficiently moving material, comprising a shovel blade, a shovel handle, joint means for attaching the shovel blade to the shovel handle, and articulation means cooperating with the joint means for permitting the operator to position the blade to a predetermined fixed angle in relation to the direction of blade movement for moving the material in a predetermined desired relation to the direction of blade movement. The articulation means is moveable between an unlocked position wherein the angle of the blade in relation to the direction of blade movement is variable and a locked position wherein the angle of the blade is locked into a fixed angle in relation to the direction of blade movement. The articulation means automatically assumes the locked position during a forward, material engaging movement of the shovel and automatically assumes the unlocked position during a rearward material disengaging movement of the shovel.

According to one preferred embodiment of the invention, the joint means comprises a first joint member carried by the shovel blade, a second joint member carried by the shovel handle, and connector means for connecting the first joint member to the second joint member.

According to another preferred embodiment of the invention, the connector means comprises at least one pin extending through both the first joint member and the second joint member.

According to yet another preferred embodiment of the invention, the connector means comprises first and second spaced-apart pins interconnecting the first joint member with the second joint member. The articulation means comprises a slot formed in one of the first or second joint members and oriented generally in the direction of blade movement within which the first pin is positioned for both translational and rotational movement, and a transversely-extending toothed opening in the same one of the first or second joint members in which the slot is formed for receiving the second pin therein, whereby forward and rearward translational movement of the first pin during material disengaging and engaging movement of the blade reciprocates the blade between unlocked and locked positions and rotational movement of the first pin while in the unlocked position moves the blade into a desired angle in relation to the direction of blade movement.

According to yet another preferred embodiment of the invention, the first joint member comprises a male joint member attached to the blade and the second joint member comprises a female joint member matingly received in the male joint member, and wherein the connector means comprises first and second spaced-apart pins carried by the female joint member and extending through the male joint member. The articulation means comprises a slot formed in the male joint member and oriented generally in the direction of blade movement within which the first pin is positioned for both translational and rotational movement, and a transversely-extending toothed opening in the male joint member for receiving the second pin therein, whereby forward and rearward translational movement of the first pin during material disengaging and engaging movement of the blade reciprocates the blade between unlocked and locked positions and rotational movement of the first pin while in the unlocked position moves the blade into a desired angle in relation to the direction of blade movement.

According to yet another preferred embodiment of the invention, the male joint member comprises a first plate, and wherein the female joint member comprises second and third spaced-apart plates positioned on respective top and bottom sides of the first plate. The shovel handle comprises an elongate shaft including a pusher bar positioned on an end distal to the blade for being engaged against and pushed by the abdomen of the user. A stabilizer bar is positioned intermediate the pusher bar and the blade for permitting the user to manually stabilize the shovel during use.

According to yet another preferred embodiment of the invention, the pusher bar comprises an elongate bar extending transverse to the axis of the handle shaft.

According to yet another preferred embodiment of the invention, the stabilizer bar comprises first and second support bars attached to the handle shaft by one end and extending outwardly at an acute angle to the handle shaft towards the pusher bar, the support bars having on a distal end thereof a transversely-extending handle bar for being grasped by the user.

Preferably, the handle bar is attached to the handle shaft.

According to yet another preferred embodiment of the invention, wheel means are carried by the shovel for permitting the shovel to be rolled into and out of material engaging position while supporting the blade at an operable position with respect to the material.

Preferably, the wheel means is releasably attached to the joint means.

According to yet another preferred embodiment of the invention, spring means are provided for interconnecting the first joint member and the second joint member for biasing the blade into the locked position in relation to the direction of blade movement.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
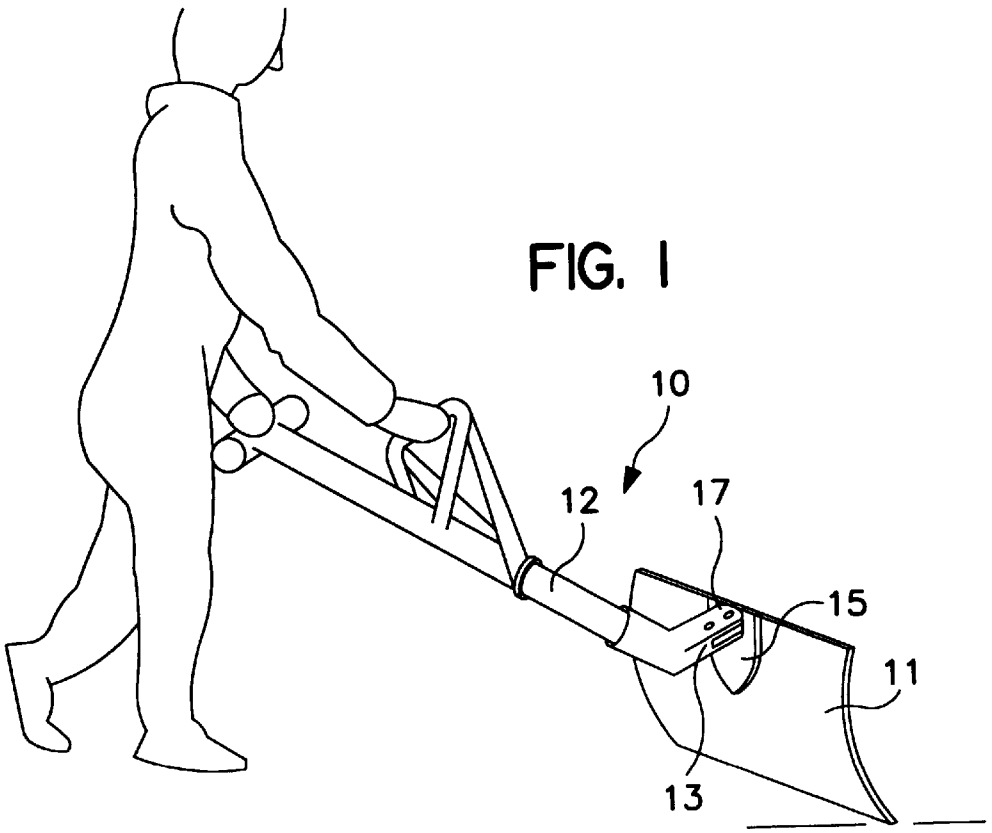
FIG. 1 is a overall view showing a shovel in use as a plow in accordance with an embodiment of the invention.
Figure 2:
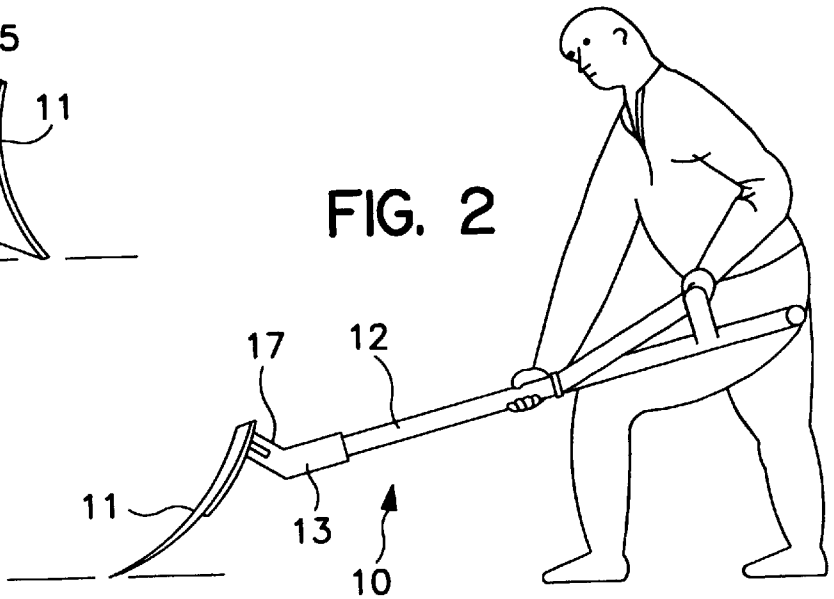
FIG. 2 is another overall view showing the shovel in use as a shovel in accordance with an embodiment of the invention.

Referring now specifically to the drawings, a shovel according to the present invention is illustrated in FIGS. 1 and 2 and is shown generally at reference numeral 10. The shovel 10 is formed of a shovel blade 11, a shovel handle 12 and a joint 13 which is used to attach the blade 11 to the handle 12. As is shown, the shovel 10 is held in such a manner that the angle between the handle 12 and the blade 11 positions the blade 11 at a very efficient angle for "plowing" snow or other materials. As is shown in FIG. 1, the shovel 10 is used by pushing the blade 11 forward with the handle 12, using the legs and hips to supply most of the forward motion. As is shown in FIG. 2, the shovel 10 can also be used in a more conventional shoveling motion. These features and the details of the handle 12 which permit these uses are disclosed in further detail below.

Figure 3:
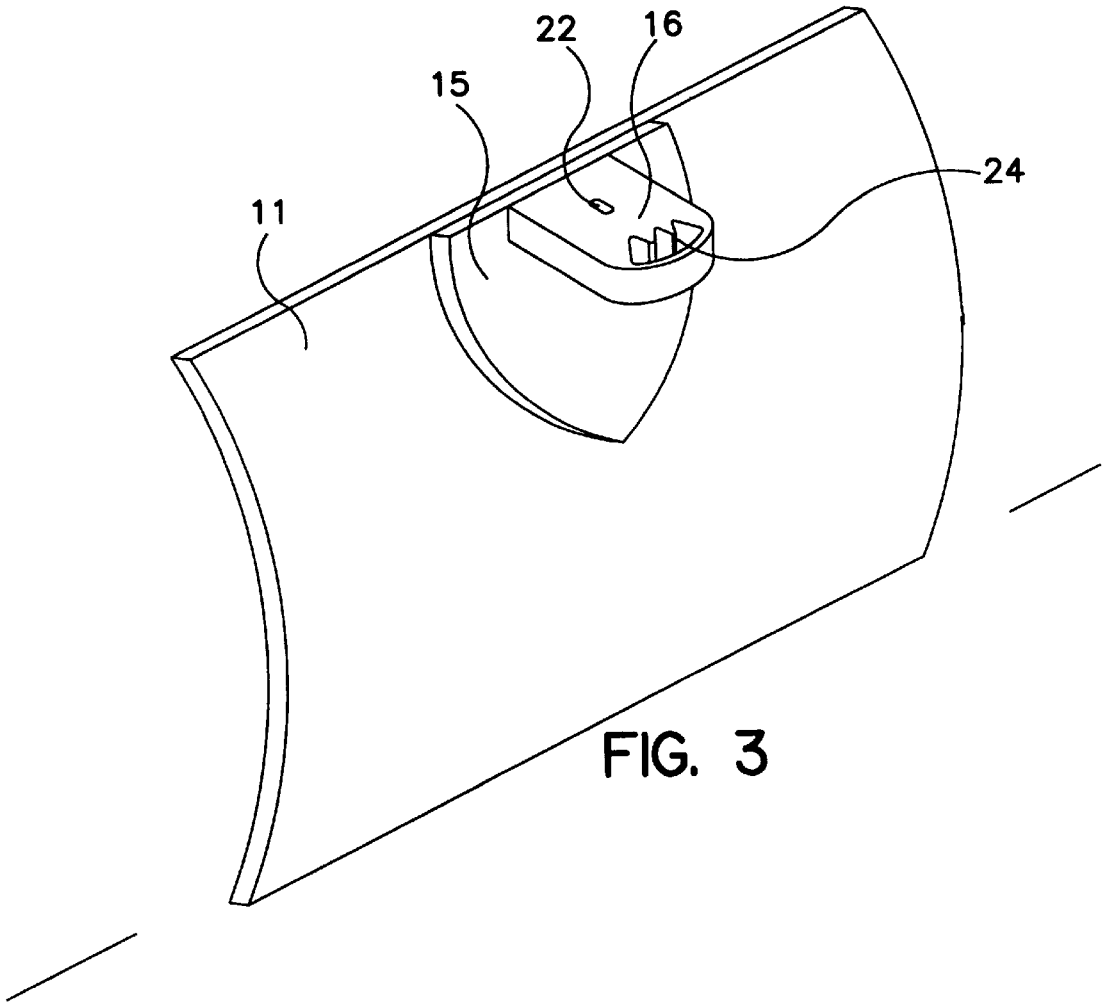
FIG. 3 is a rear view of the blade of the shovel.
Figure 4:
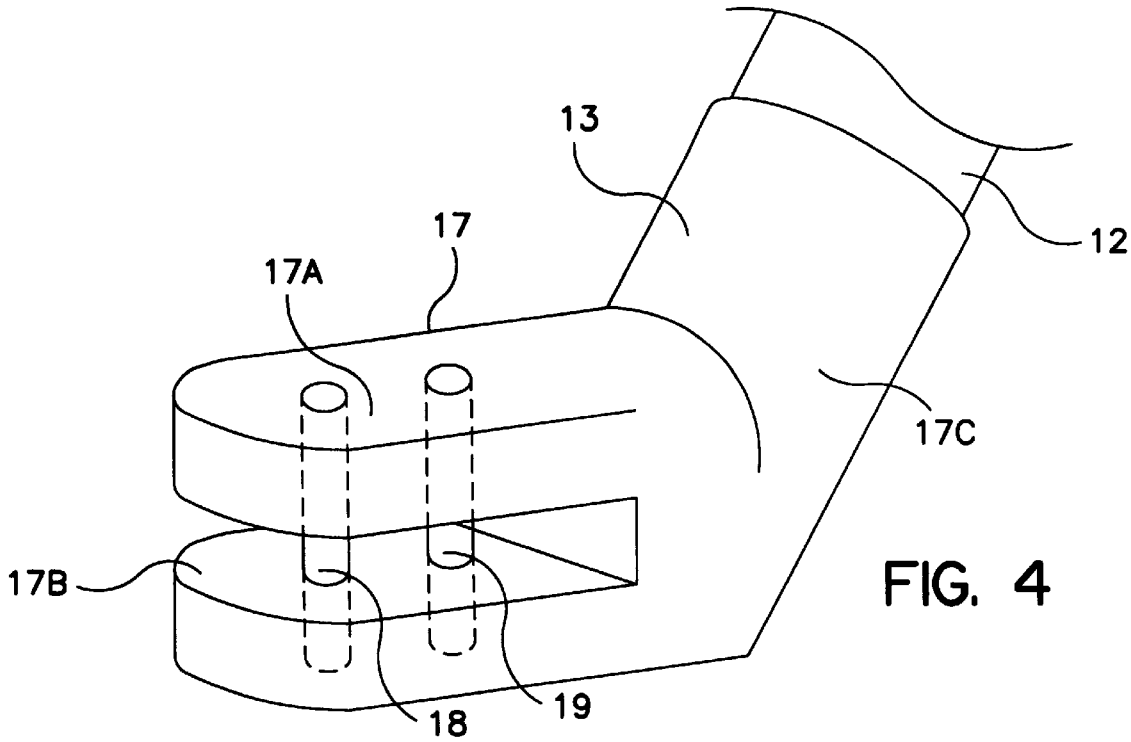
FIG. 4 is a fragmentary perspective view of the female joint member of the shovel.
Figure 5:
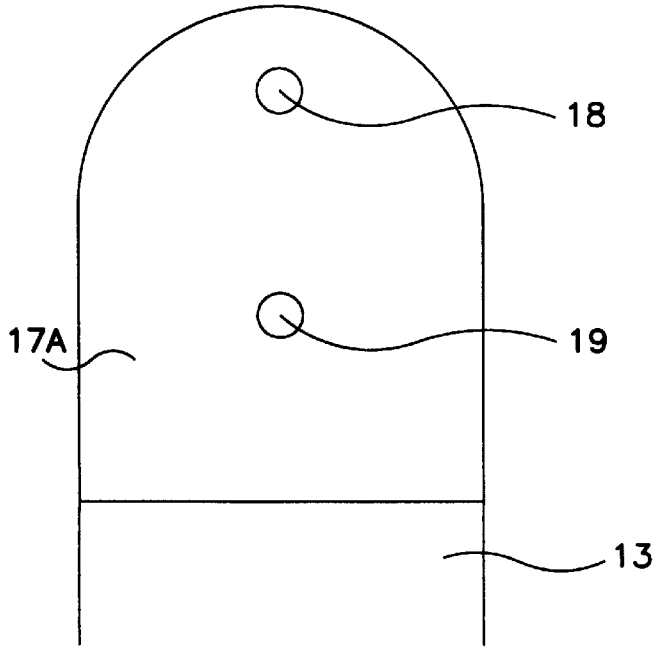
FIG. 5 is a top plan view of the female joint member of the shovel as shown in FIG. 4.

Referring to FIG. 3, the blade 11 has a convex rear surface on which is mounted a reenforcing plate 15 which carries a male joint member 16 of the joint 13. As is shown in FIGS. 4 and 5, the male joint member 16 cooperates with a female joint member 17, which is formed of a pair of spaced-apart plates 17A and 17B positioned on one end of the handle 12 in any conventional manner, as, for example, a tubular socket 17C. Two pins 18 and 19 are positioned in suitably-formed holes and extend through the gap between the plates 17A and 17B in the manner shown. These pins 18 and 19 may be any suitable elongate member, such as iron or steel pins, bolts or rods, and may be permanently secured to the plates 17A, 17B or releasably attached with nuts, cotter pins or the like.

Figure 6:
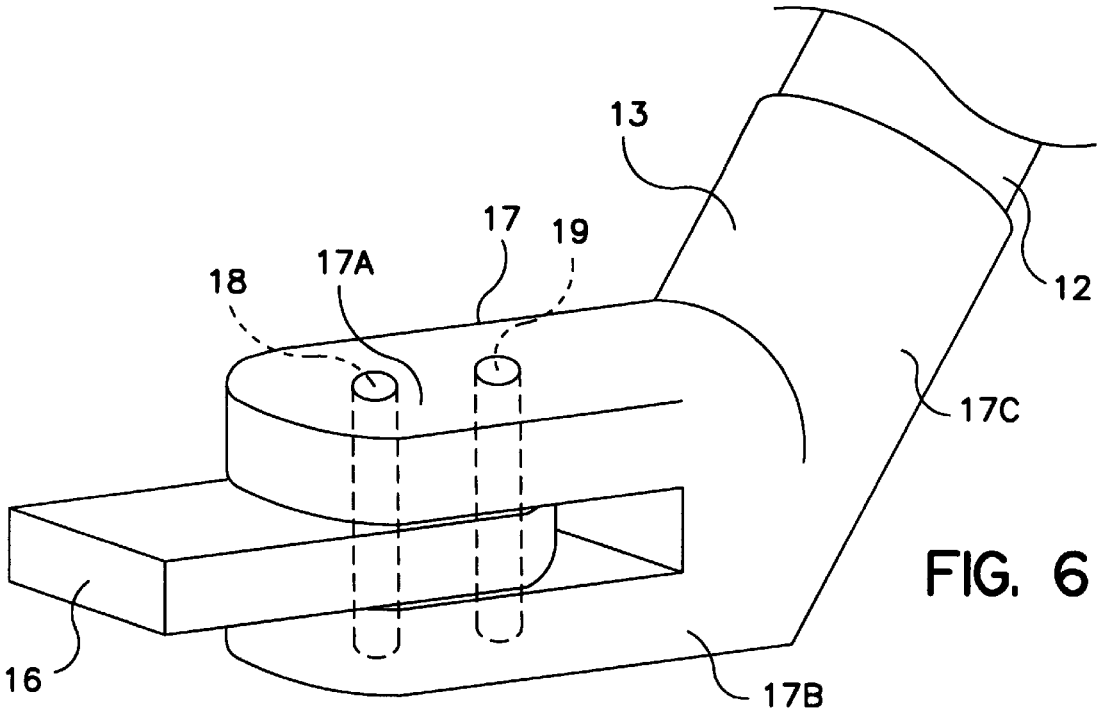
FIG. 6 is a assembled view of the male and female joint members of the shovel.
Figure 7:
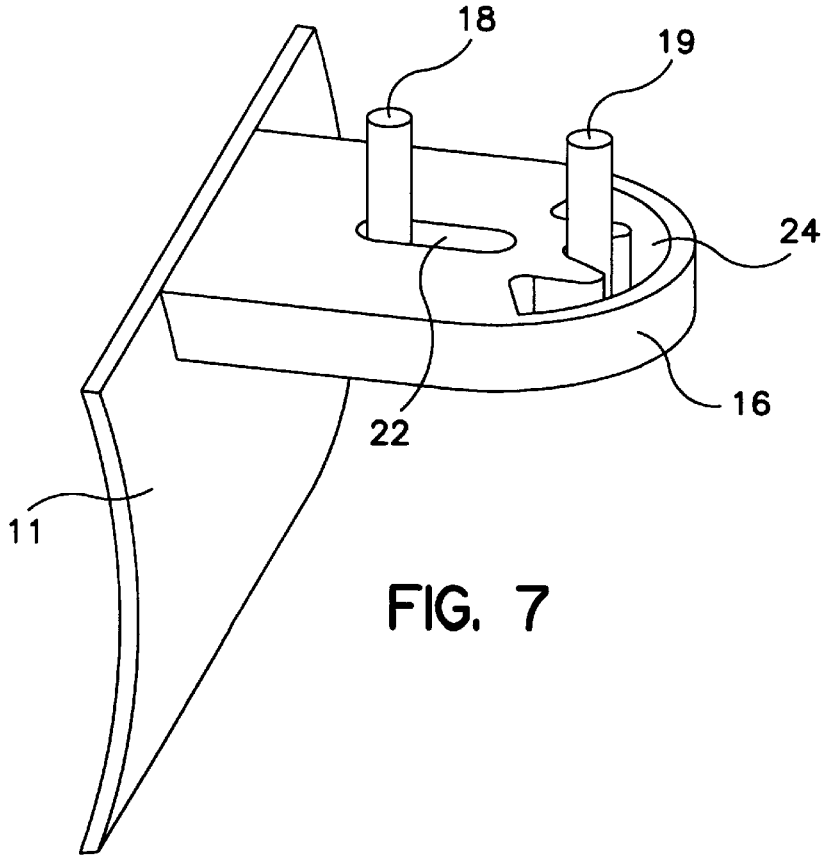
FIG. 7 is a fragmentary disassembled perspective view of the male joint member.

As is shown in FIG. 6, the male plate 16 is positioned in the gap between the plates 17A, 17B of the female joint member 17. As is shown more specifically in FIGS. 7, 8 and 9, the male joint plate 16 includes a slot 22 which extends generally along the axis of movement of the shovel 10 during use. The male joint plate 16 also includes a transversely-extending toothed opening 24. The teeth define notches 25, 26 and 27 in the plate 16. As is shown, the slot 22 and opening 24 are positioned to receive the pins 18 and 19. These pins 18 and 19 function to permit the use of the shovel 10 in the manner described herein.

Figure 8:
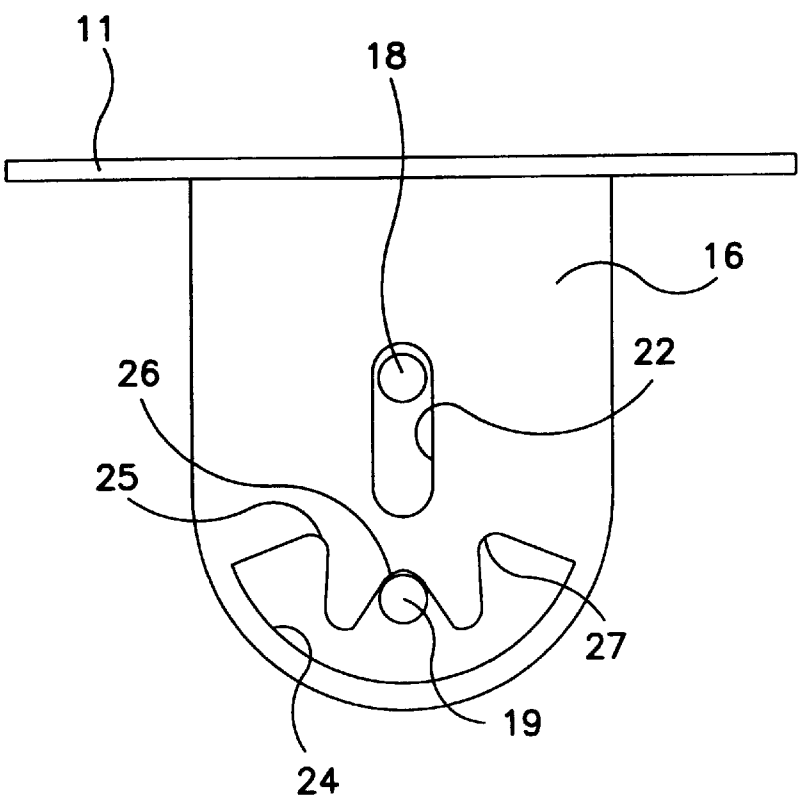
FIG. 8 is a top plan view of the male joint member in an engaged position.

Specifically, when the user pushes the handle 12 forward in a plowing motion, as shown in FIG. 1, the pins 18, 19 are pushed forward in the slot 22 and toothed opening 24. Depending on the angle formed between the handle 12 and blade 11, the pin 18 is captured by one of the three notches 25, 26 and 27. As shown in FIG. 8, the pin 18 is captured in the center notch 26 and results in a center-oriented position where the blade 11 pushes the material straight ahead.

Figure 9:
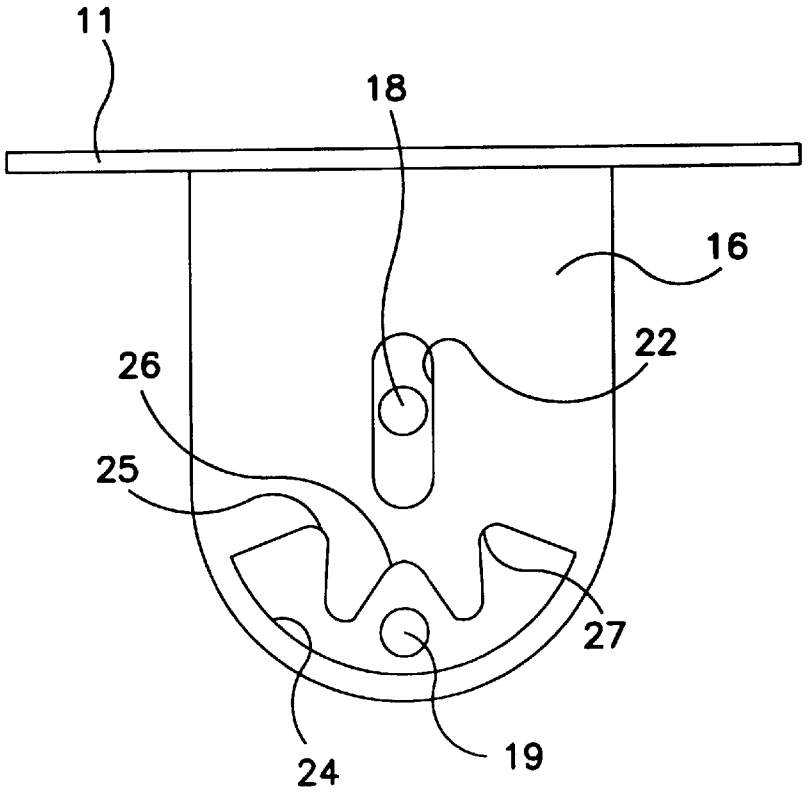
FIG. 9 is a top plan view of the male joint member in a disengaged position.

When the user pulls back on the handle 12, the pins 18 and 19 disengage, as shown in FIG. 9. In this position the user may pivot the handle 12 relative to the blade 11, with the pin 18 comprising the pivot point. For example, by pivoting the handle 12 to the right the pin 19 will move to the right, and when the handle 12 is pushed forward for a new plowing stroke, the pin 19 will move forward into the notch 27, locking the blade 11 into an offset angle with respect to the direction of forward plowing movement of the blade 11. Snow or other materials will be pushed to the right as the blade 11 moves forward.

Conversely, by pivoting the handle 12 to the left, the pin 19 will move to the left and when the handle 12 is pushed forward for a new plowing stroke, the pin 19 will move forward into the notch 25, locking the blade 11 into an offset angle with respect to the direction of forward plowing movement of the blade 11. Snow or other materials will be pushed to the left as the blade 11 moves forward. The direction of snow movement may be changed at will—on every stroke if desired—merely by pivoting the handle 12, and without stopping to make any adjustment to the handle 12 or blade 11.

Figure 10:
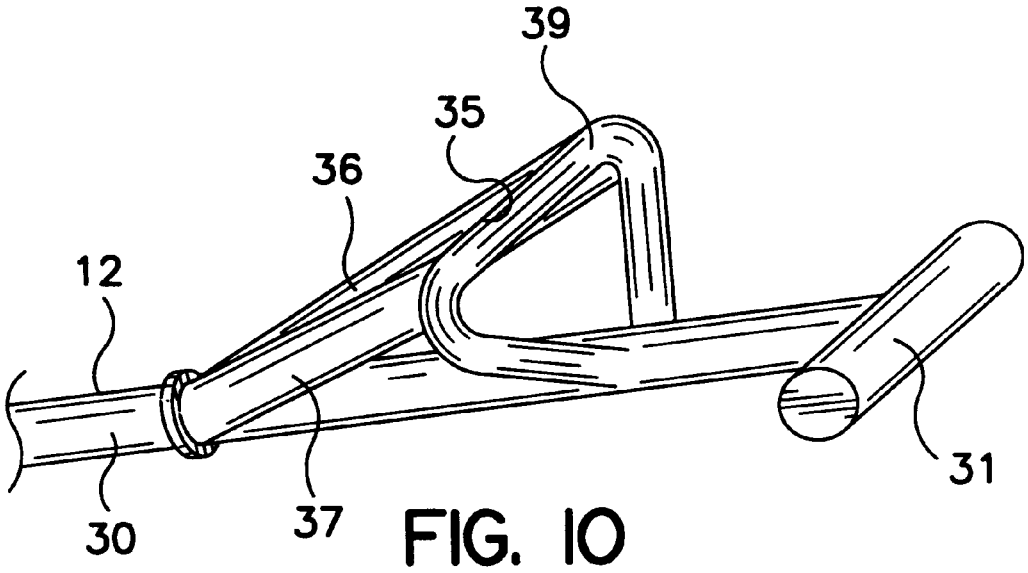
FIG. 10 is a fragmentary perspective view of the shovel, showing the shovel handle according to a preferred embodiment.
Figure 11:
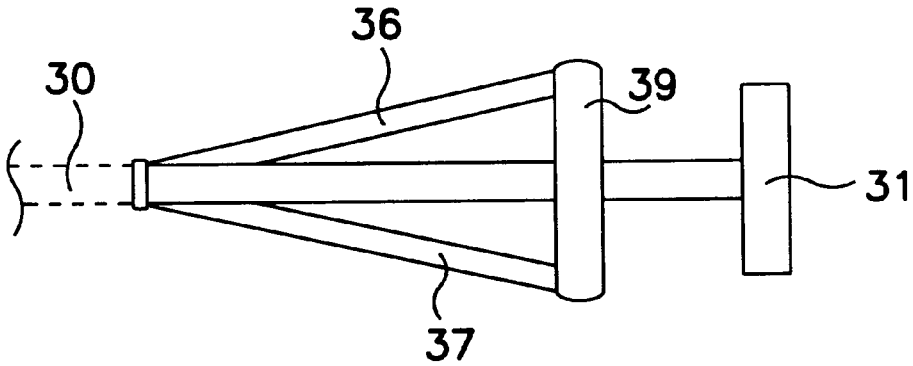
FIG. 11 is a fragmentary top view of the shovel handle.
Figure 12:
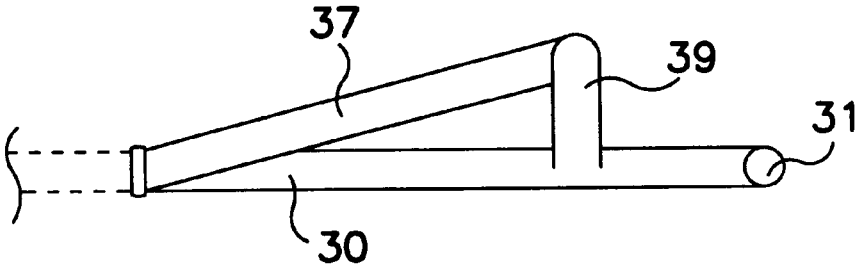
FIG. 12 is a fragmentary side elevation view of the shovel handle.

The ease of use of the shovel 10 is enhanced by the design of the handle 12. As is shown in FIGS. 10, 11 and 12, the handle 12 includes a handle shaft 30, the distal end of which includes a transversely-extending pusher bar 31. As is shown in FIG. 1, the pusher bar 31 is positioned on the abdomen of the user and assists in pushing the shovel 10 forward. Applying force from this position requires the hips and legs to do majority of the work of pushing the shovel 10 forward.

Handle 12 also includes a stabilizer bar 35. Stabilizer bar 35 is formed of a pair of support bars 36 and 37 which diverge from the handle 12 towards the distal end and terminate with a handle bar 39 for being grasped by the user. The handle bar 39 permits the user to apply greater and more precise leverage to the shovel 10 while plowing in the manner shown in FIG. 1, or shoveling in the manner shown in FIG. 2.

Figure 13:
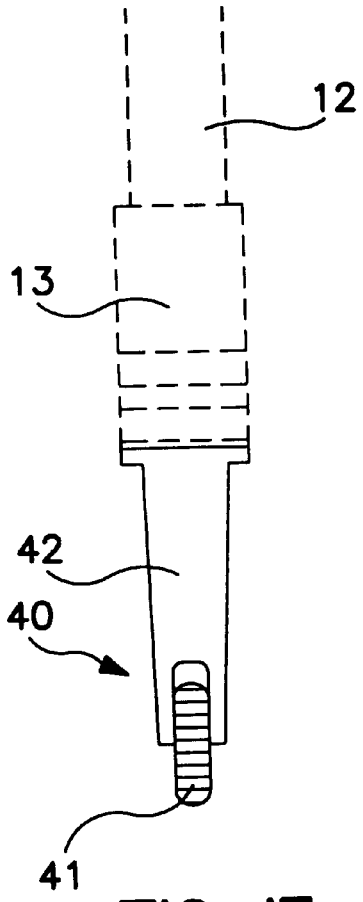
FIG. 13 is a fragmentary front view of the shovel showing the optional wheel means for use with the shovel.
Figure 14:
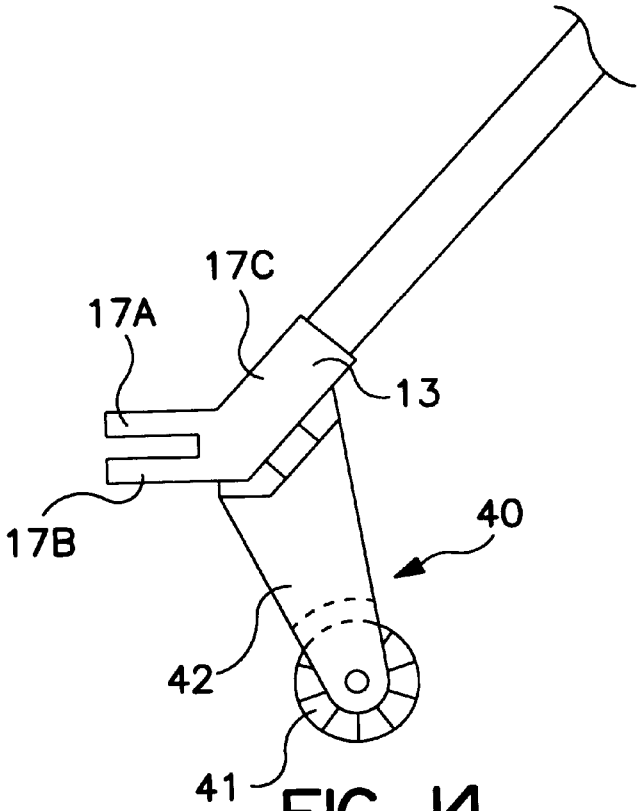
FIG. 14 is a fragmentary side elevation view of the wheel means shown in FIG. 13.

Referring now to FIGS. 13 and 14, the shovel may be supported by a wheel assembly 40. A wheel 41 is supported by a wheel support 42 which may be attached in any suitable manner to the bottom side of the joint 13. The wheel assembly 40 is preferably detachable by use of suitably sized bolts. The wheel assembly 40 is useful in maneuvering a shovel 10 having a large, heavy duty blade 11, although it limits use of the shovel 10 in the manner shown in FIG. 2.

Figure 15:
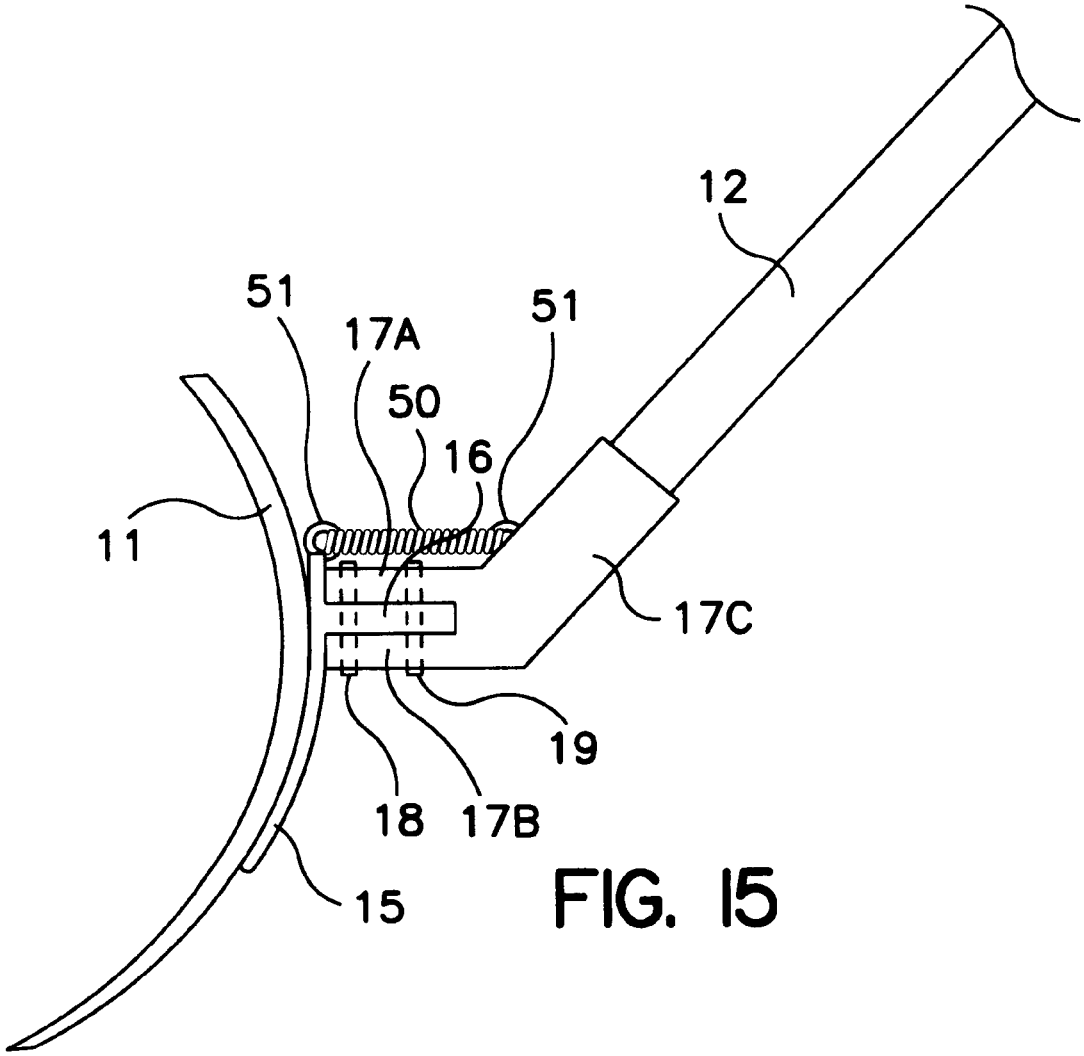
FIG. 15 is a fragmentary side elevation view of the shovel, showing an optional spring means which biases the locking means in the locked position.

As is shown in FIG. 15, a tension spring 50 may be used to lock the blade 11 and handle 12 into a desired position. An eyelet 51 on the reenforcing plate 15 and an eyelet on the socket 17C retain opposite ends of the spring 50 under sufficient tension to maintain the pin 19 in the desired notch 25, 26 or 27 during not only the forward pushing stroke, but on the return stroke when the pin 19 would normally be withdrawn from the notch. Use of the spring 50 requires that the user disengage the spring 50 by hand in order to reposition the pin 19 in the desired notch 25, 26 or 27.

The handle 12 is also useable with any other implement having a mating attachment means. Implements such as spray washers, string trimmers and edgers can also be used, taking advantage of the same handle features described above. The blade 11 is removed by removing the pins 18, 19 and the new implement having a mating male joint member placed in position on the female joint member 17. The pins 18, 19 are then replaced.

As is shown and described above, the features of the shovel 10 permit its use in an efficient manner and with reduced exertion by the user. The hands are used principally to guide and direct the shovel with the large muscles in the hips and legs doing the majority of the work.

A shovel is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A manually-operable shovel for efficiently moving material, comprising:

(a) a shovel blade;

(b) a shovel handle;

(c) joint means for attaching the shovel blade to the shovel handle, comprising a first joint member carried by said shovel blade, a second joint member carried by said shovel handle;

(d) connector means comprising at least one pin interconnecting the first joint member with the second joint member; and (e) articulation means cooperating with said joint means for permitting the operator to position the blade to a predetermined fixed angle in relation to the direction of blade movement for moving the material in a predetermined desired relation to the direction of blade movement, said articulation means comprising a slot formed in one of the first or second joint members and oriented generally in the direction of blade movement within which said at least one pin is positioned for both translational and rotational movement, and a transversely-extending toothed opening in the same one of the first or second joint members in which the slot is formed for receiving a second pin therein, whereby forward and rearward translational movement of said at least one pin during material disengaging and engaging movement of the blade reciprocates the blade between unlocked and locked positions and rotational movement of said at least one pin while in the unlocked position moves the blade into a desired angle in relation to the direction of blade movement, whereby said articulation means is moveable between:

(i) an unlocked position wherein the angle of the blade in relation to the direction of blade movement is variable; and (ii) a locked position wherein the angle of the blade is locked into a fixed angle in relation to the direction of blade movement; and (iii) further wherein the articulation means automatically assumes the locked position during a forward, material engaging movement of the shovel and automatically assumes the unlocked position during a rearward material disengaging movement of the shovel, whereby the shovel is adaptable for selectively lifting and displacing or pushing and displacing the material.

2. A manually-operable shovel according to claim 1, wherein said first joint member comprises a male joint member attached to the blade and the second joint member comprises a female joint member matingly received in said male joint member, and wherein the connector means comprises:

(a) first and second spaced-apart pins carried by the female joint member and extending through the male joint member; and (b) wherein said articulation means comprises:

(i) a slot formed in the male joint member and oriented generally in the direction of blade movement within which the first pin is positioned for both translational and rotational movement; and (ii) a transversely-extending toothed opening in the male joint member for receiving the second pin therein, whereby forward and rearward translational movement of the first pin during material disengaging and engaging movement of the blade reciprocates the blade between unlocked and locked positions and rotational movement of the first pin while in the unlocked position moves the blade into a desired angle in relation to the direction of blade movement.

3. A manually-operable shovel according to claim 2, wherein said male joint member comprises a first plate, and wherein said female joint member comprises second and third spaced-apart plates positioned on respective top and bottom sides of said first plate.

4. A manually-operable shovel according to claim 2 or 3, wherein said shovel handle comprises an elongate shaft including a pusher bar positioned on an end distal to the blade for being engaged against and pushed by the abdomen of the user; and (a) a stabilizer bar positioned intermediate the pusher bar and the blade for permitting the user to manually stabilize the shovel during use.

5. A manually-operable shovel according to claim 4, wherein the pusher bar comprises an elongate bar extending transverse to the axis of the handle shaft.

6. A manually-operable shovel according to claim 4, wherein the stabilizer bar comprises first and second support bars attached to the handle shaft by one end and extending outwardly at an acute angle to the handle shaft towards the pusher bar, the support bars having on a distal end thereof a transversely-extending handle bar for being grasped by the user.

7. A manually-operable shovel according to claim 6, wherein said handle bar is attached to the handle shaft.

8. A manually-operable shovel according to claim 2, and including wheel means carried by the shovel for permitting the shovel to be rolled into and out of material engaging position while supporting the blade at an operable position with respect to the material.

9. A manually-operable shovel according to claim 8, wherein said wheel means is releasably attached to the joint means.

10. A manually-operable shovel according to claim 2, and including spring means interconnecting the first joint member and the second joint member for biasing the blade into the locked position in relation to the direction of blade movement.

* * * * *